United States Patent [19]

Ohtani et al.

[11] 4,394,187

[45] Jul. 19, 1983

[54] METHOD OF MAKING STEELS WHICH ARE USEFUL IN FABRICATING PRESSURE VESSELS

[75] Inventors: Hiroo Ohtani; Seiichi Watanabe, both of Amagasaki, Japan

[73] Assignee: Sumitomo Metal Industries, Ltd., Osaka, Japan

[21] Appl. No.: 238,030

[22] Filed: Feb. 25, 1981

[51] Int. Cl.[3] ..... C22C 38/22; C22C 38/32; C21D 8/02

[52] U.S. Cl. ..... 148/12 F; 75/126 C; 75/126 P; 148/12.3; 148/36; 148/144

[58] Field of Search ..... 148/12 F, 36, 12 R, 148/12.3, 142, 134, 143, 144; 75/126 P, 126 C, 123 B, 123 J, 124 B

[56] References Cited

U.S. PATENT DOCUMENTS

| | | | |
|---|---|---|---|
| 3,264,145 | 8/1966 | Steiner | 148/142 |
| 3,328,211 | 6/1967 | Nakamura | 148/12 F |
| 3,463,677 | 8/1969 | Nakamura et al. | 75/126 P |

FOREIGN PATENT DOCUMENTS

| | | | |
|---|---|---|---|
| 54-42326 | 4/1979 | Japan | 148/36 |
| 54-24684 | 8/1979 | Japan | 75/124 BA |
| 55-24966 | 2/1980 | Japan | 75/124 B |
| 55-164035 | 12/1980 | Japan | 148/12 F |
| 861192 | 2/1961 | United Kingdom | 75/126 P |

*Primary Examiner*—Peter K. Skiff

*Attorney, Agent, or Firm*—Watson, Cole, Grindle & Watson

[57] ABSTRACT

Chromium-molybdenum structural steels which have high tensile strength, low susceptability to temper embrittlement, high hydrogen attack resistivity and high temperature ductility and which can be formed into very thick steel plates comprise 0.05 to 0.20% of C, 0 to 0.15% of Si, 0.46 to 1.00% of Mn, 2.00 to 3.50% of Cr, 0.80 to 1.20% of Mo, 0.00015 to 0.0015% of B, 0.005 to 0.070% of Sol. Al and inevitably entrained impurities, the balance to make up 100% of Fe. Preferably the inevitably entrained impurities of nitrogen and phosphorus are below 0.0060% of N and 0.0010% of P.

4 Claims, 3 Drawing Figures

METHOD OF MAKING STEELS WHICH ARE USEFUL IN FABRICATING PRESSURE VESSELS

BACKGROUND OF THE INVENTION

1. Field of the Invention

The present invention relates to structural steels which are useful in fabricating pressure vessels, and more particularly it relates to improved chromium-molybdenum type steels which can be formed into thick plates that are weldable together to make chemical pressure vessels.

2. The Prior Art

Pressure vessels used in oil refining installations and coal liquifaction facilities must be capable of withstanding high temperatures and must display a strong resistivity to hydrogen attack. Many pressure vessels must also pass specific water pressure tests, e.g., when they are used as boilers. Some pressure vessels must particularly possess satisfactory low-temperature toughness. One type of commonly used materials for fabricating such pressure vessels is the 2¼Cr-1Mo type steels, which display generally good strength, creep resistivity and hydrogen attack resistivity at elevated temperatures. However, when these steels are exposed to high temperatures (e.g., from 400°-550° C.) over long periods of time, they display heavy embrittlement and lose their toughness. At the same time, growing demand for pressure vessels having enlarged dimensions and which are capable of withstanding increased working pressures has entailed the use of Cr-Mo steel plates having increased thicknesses, e.g., of 100 mm or more. However, when manufacturing steel plates of such thicknesses, the cooling rate for the plates during the normalizing treatment will be reduced, thereby lowering their strengths and toughnesses, as well as limiting the conditions under which stress relief annealing after welding or post weld heat treatment (hereinafter abbreviated as PWHT) can be conducted (after welding) and making it difficult for the steels to retain the necessary strengths subsequent to the PWHT.

Investigations into the effects on temper embrittlement (Δ vTs) resulting from the addition of phosphorus and silicon to 2 to 3Cr-1Mo steel plates of 150 mm in thickness, which plates have been subjected to heat treatments comprising the steps of heating at 940° C. for one hour, normalizing by placement in air, standing at 710° C. for ten hours, and then PWHT, are represented in the graph in the attached FIG. 1. The investigations on temper embrittlement of steel plates of 150 mm in thickness subjected to normalizing at 940° C. for one hour and PWHT at 710° C. for 10 hours, which plates have been produced by rolling the base steels with variation of P and Si contents containing in 0.15C-0.65Mn-2.7Cr-1.0Mo steel at 1100° C. for one hour, are represented in the attached FIG. 1. Δ vTs represents the difference in a fractum transition temperature of V-notch Charpy test (vTs) before and after the step cooling having a heat pattern shown in FIG. 3, the values of which are indicated respectively by the encircled figures in FIG. 1.

The results of the investigations on steel plates of 50 mm in thickness subjected to normalizing at 930° C. for one hour and PWHT at 710° C. for ten hours, which plates have been produced by rolling the base steels with variation of Si content containing in 0.15C-0.50Mn-2.7Cr-1.0Mo steel at 1,100° C. for one hour, are represented in the attached in FIG. 2. It can be seen that in each case embrittlement was improved by lowering the phosphorus and silicon contents. However, it should be remembered that lowering the phosphorus content (for example, to less than 0.010%) cannot be achieved without a special (and costly) processing step, and that lowering the silicon content concurrently results in a loss of strength shown in FIG. 2.

One proposal for solving the noted problems is disclosed in JA-OS No. 41962/1980 (laid open for public inspection on Mar. 25, 1980). In this proposal, the employed Cr-Mo steels have aluminum and boron or boron and titanium added thereto. However, when steel plates having thicknesses exceeding 100 mm are produced from the steels, they are deficient in strength and toughness, i.e., because of a low manganese content. Furthermore, this proposal allows for a wide range of boron content, often exceeding 0.0015%, which indicates that the steel plates suffer from ferrite precipitation during the normalizing treatment and fail to acquire a sufficient strength. Thus, this proposal does not produce steel plates which exhibit sufficient strength, sufficient endurance to high-temperature PWHT, sufficient properties at its heat-affected zones (hereinafter abbreviated as HAZ), or allow for the inclusion of silicon. Also, they employ excess amounts of boron.

An object of the present invention is to provide high tensile strength structural steels which will form thick plates useful in fabricating pressure vessels, which steels will display little tempering embrittlement and low cost.

SUMMARY OF THE PRESENT INVENTION

The present inventors have found that Cr-Mo type steels, and especially 2¼Cr-1Mo steels, will display all of the required properties for thick plates needed to make pressure vessels when they contain 0 to 0.15% of silicon, 0.46 to 1.0% of Mn, 0.00015 to 0.0015% of boron and 0.005 to 0.070% of Sol. Al. The inventors have found that the addition of the noted specific amounts of Sol. Al and the noted minute amounts of boron reduces ferrite transformation during the normalizing treatment (which enhances the strengths of the steels) that compensates for the reduced strengths occasioned by the low silicon levels which are desired to achieve low temper embrittlement. They have further discovered that when the boron content of the steels is high, the cooling rate during normalizing is so slow that boron is precipitated in the austenite grain boundary, that ferrite transformation is encouraged, and that the strength of the steel is impaired; in addition, the steel displays high susceptibility to stress relief cracking. On the other hand, decreased boron content improves the steel's toughness after the PWHT. Thus, the steels of the present invention can be made to display excellent properties.

DETAILED DESCRIPTION OF THE INVENTION

Figure 1:
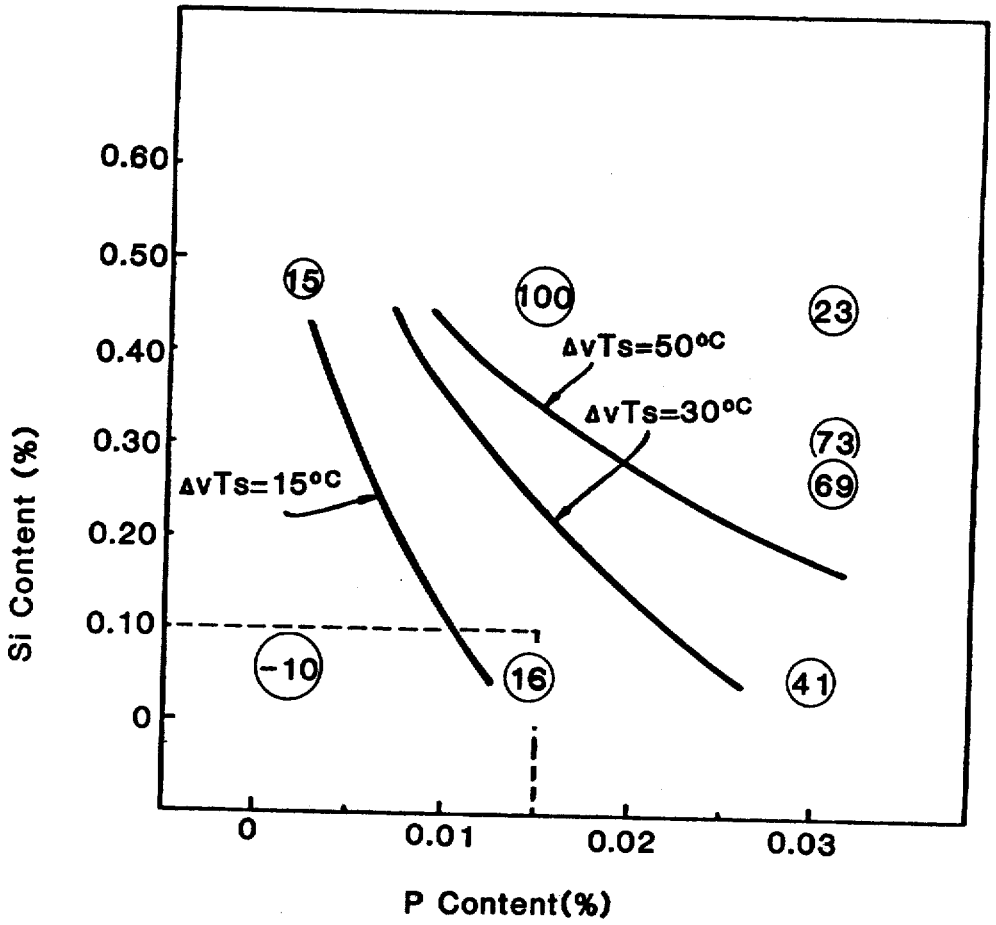
FIG. 1 is a graph showing the relationship between the temper embrittlement (Δ vTs) and the contents of P and Si.
Figure 2:
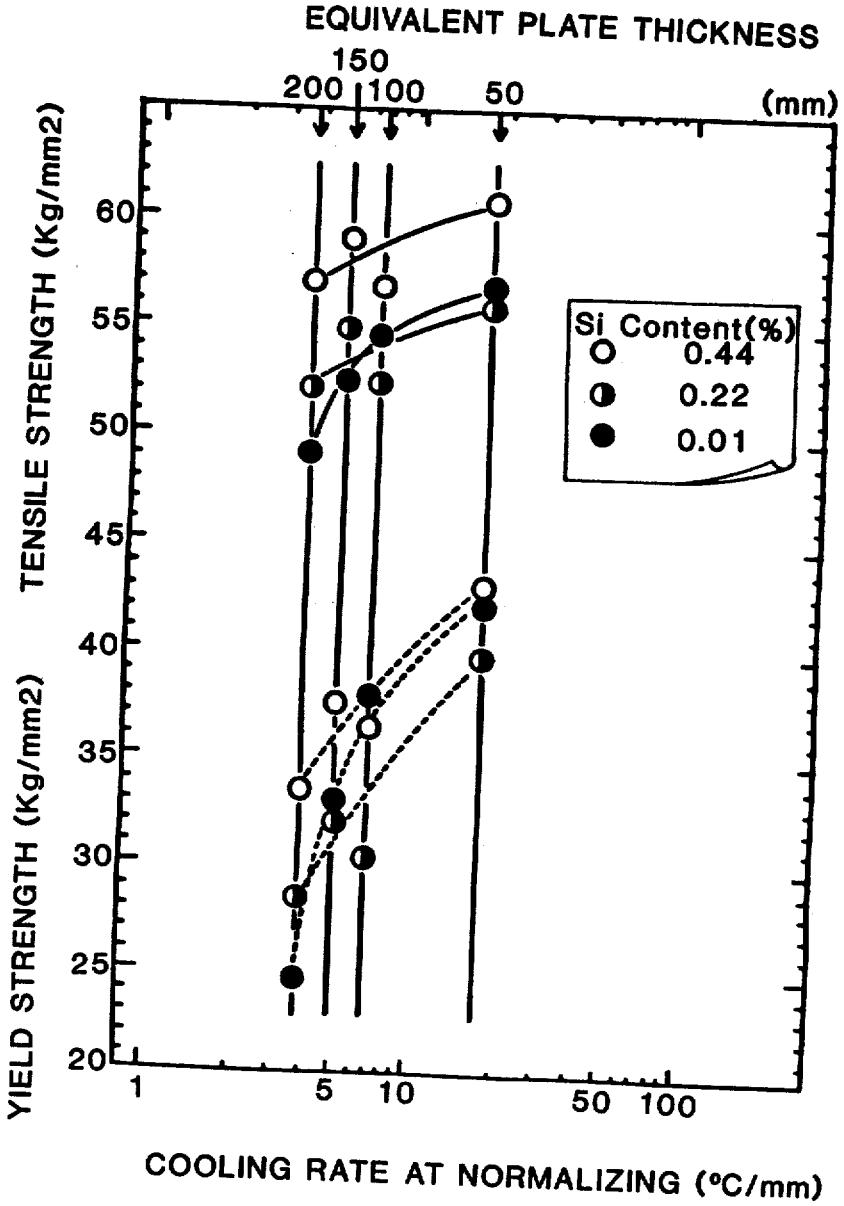
FIG. 2 is a graph showing the relationship between Si and the strength and the plate thickness which is varied equivalently with cooling rate at normalizing.

The inventors have discovered that a steel composition containing 0.05 to 0.20% of C, 0 to 0.15% of Si, 0.46 to 1.00% Mn, 200 to 3.50% of Cr, 0.80 to 1.20% Mo, 0.00015 to 0.0015% of B, 0.005 to 0.070% of Sol. Al and the balance (to make up 100%) of Fe (together with impurities inevitably entrained by the components of the composition) gives highly favorable results. Further explanations of the reasons behind the required ranges noted for the carbon, silicon, manganess, chromium, molybdenum, boron and Sol. Al are as follows.

Since carbon intensifies the tempering embrittlement, the carbon content should be as low as possible. On the other hand, carbon is a primary element which is indispensable to achieving the necessary strength and, in this respect, must be added in an amount of not less than 0.05%. When the carbon content exceeds 0.20%, however, the excess carbon impairs the steel's toughness and weldability and increases temper embrittlement. Thus, the carbon content must be from 0.05 to 0.20%. Further, to achieve ample high-temperature strength, the carbon content is preferably not less than 0.09%, whereas in steels produced solely by the normalizing treatment so as to avoid ruptures during cold processing, the carbon content is preferably not more than 0.17%.

The steels will acquire advantageous quality when silicon is utilized for deoxidation in conjunction with aluminum. Moreover, silicon is an important element from the viewpoint of providing high strength. However, the inventive steels will be seriously embrittled during operation of vessels at an elevated temperature (400°-550° C.), i.e., temper embrittlement, if the silicon content is too high. The upper limit for the silicon, i.e., 0.15%, is important because temper embrittlement will be conspicously aggravated when the Si content is in excess of 0.15%. When the silicon content is 0.08% or less the temper embrittlement is notably diminished in both the base metal and HAZ. Thus, the silicon content is desirably less than 0.08%. Generally, the raw materials for the ingredients of the steel entrain silicon. By careful selection of such raw materials and by adoption of the technique of vacuum degasification, the steel quality can be improved to a point where silicon it totally absent and the possibility of temper embrittlement is notably prevented.

Manganese is necessary for the purpose of heightening hardenability during the normalizing treatment and, at the same time, ensuring strength and toughness for the steel plates produced so as to have great thicknesses. For this purpose, the manganese content must be not less than 0.46%. When manganese is added excessively, however, the excess manganese acts to degrade weldability and aggravate temper embrittlement. Thus, the upper limit for the Mn content is fixed at 1.00%

Chromium is necessary for improving hardenability during normalizing and also heightening hydrogen attack resistivity. For this purpose, the chronium content must be not less than 2.00%. When the chromium content exceeds 3.50%, however, the excess chromium causes a loss of weldability. The upper limit of the chromium content, therefore, is fixed at 3.50%. Further, since the hydrogen attack resistivity improves with increasing chromium content, it is desirable to adopt the range standardized in ASTM standard and generally practiced in actual production, i.e., the range from 2.25 to 2.50% of chromium in 2¼Cr-1Mo steels or the range of from 2.75 to 3.50% of chromium in 3Cr-1Mo steels.

Molybdenum serves to enhance hardenability at the time of normalizing and increase strength both at room temperature and at elevated temperatures. For this purpose, the molybdenum content must be not less than 0.80%. When the molybdenum content exceeds 1.20%, however, the excess molybdenum creates a loss in toughness (despite an increase in strength). Thus, the molybdenum content must be from 0.80 to 1.20%.

Boron is capable of enhancing hardenability during normalizing as already described. To produce the microstructure consisting essentially of bainite, the boron content must be not less than 0.00015%. When the boron content exceeds 0.0015%, however, the excess boron acts to exaggerate the susceptibility to stress relief cracking, induce precipitation of ferrite during normalization and cause loss of strength (and make it difficult to obtain the desired strength). Thus, the boron content must be from 0.00015 to 0.0015%. Further, to ensure the desired effects of boron upon hardenability and minimize the possibility of strength dispersion, the boron content is preferably not more than 0.0009%, the excess boron results in a reduction in the toughness in the HAZ. Thus, the preferred range of boron is from 0.0002 to 0.0009%.

The Sol. Al acts to fix nitrogen in the form of AlN and permits thorough deoxidation. The Sol. aluminum content, therefore, must be not less than 0.005%. When it exceeds 0.070%, however, the excess Sol. Al impairs hot workability and induced surface cracks and other detrimental phenomena. Thus, the range of Sol. Al must be from 0.005 to 0.070%. To ensure the desired effects of the boron, the Sol. Al content is preferably not less than 0.020%. On the other hand, if it exceeds 0.050%, the excess Sol. Al degrades the toughness in the HAZ. The preferred range of Sol. Al is accordingly from 0.020 to 0.050%.

Nitrogen, being one of the inevitably entrained impurities, when contained in an amount exceeding 0.0060%, increases AlN and consequently degrades hot workability. It is highly desirable, therefore, that the nitrogen content be below 0.0060% by sealing (with argon) the steelmaking.

Phosphorus, another of the family of inevitably entrained impurities, is segregated in the austenite grain boundary and degrades ductility at elevated temperatures. To preclude the degradation of ductility and improve high-temperature ductility, creep ductility and resistance to temper embrittlement, the phosphorus content is desirably not more than 0.010%.

The heat treatment involved in the production of thick plates of steel according to the present invention generally comprises a normalizing step (for example, at 900° to 970° C.) and a tempering step (for example, at 650° to 750° C. for 0.5 to about 10 hours).

In situations where the nitrogen content is high (for example, when it exceeds 0.0060%), it is desirable to take any of the following measures in the course of production for the purpose of ensuring the desired effects of boron and for securing the necessary strength:

(1) Heating temperature of slab for plate rolling is below 1150° C.;

(2) After the rolling step, the steel plate is gradually cooled at a rate of not more than 30° C./hour.

(3) The normalizing step is performed twice, with the first normalizing operation performed at a higher temperature (900° to 1000° C.) and the last one at a regular temperature (900° to 970° C.).

In order to enhance the hardening effect of boron, prior to normalizing, it is necessary for the nitrogen to be fixed (or compounded) with aluminum in the form of AlN and for the boron to be converted to free boron. Since both boron and nitrogen are readily segregated in the austenite grain boundary and conversely aluminum is segregated very little, boron and nitrogen which are in a non-equalibrium state tend to be precipitated, particularly when the nitrogen content is high. Further, when the slab heating temperature is above 1150° C., Al, B and N dissolve into the steel during the slab heating process and B is easily precipitated in proportion to the fall in the temperature during and after the plate rolling.

The reaction of $BN+Al \rightarrow B+AlN$ can be completed by proceeding it at 1000° C. for 30 minutes or a gradual cooling (lower than 30° C./hr.)

Therefore, when N content exceeds 0.0060%, by performing any one process of heating the slab at below 1150° C., gradual cooling after rolling and high temperature normalizing (950° to 1000° C.) prior to the regular temperature normalizing (900° to 970° C.), nitrogen is fixed with aluminum to be in the form of AlN and boron is converted to free boron so that the desired hardening effect of boron can be obtained.

The steels of this invention have the salient feature that they enable the HAZ to be softened in texture and the HAZ properties to be improved after undergoing a thorough high-temperature PWHT. These steels manifest their true advantages after they have undergone a PWHT at elevated temperatures within the range of from 675° to 740° C.

Further, the steels of this invention are increased in hydrogen attack resistivity as their chromium contents are raised up to the specified upper limit. Since the silicon content can be decreased commensurately with the increase of strength achieved by the increased Mn content and Al and B treatment, the steels provided by this invention show very low temper embrittlement in both the base metal and the HAZ.

Furthermore, the effects of boron are ensured and the hot workability is improved by limiting the content of nitrogen and also by keeping the content of phosphorus down to a low level, among other impurities. By additionally lowering the phosphorus content, the steels provided by this invention show low tempering embrittlement, excellent creep ductility and will endure under extremely harsh use conditions. Example Steels having the chemical composition as shown in Table 1 were prepared by induction melting. These steels were formed into the plates under the manufacturing conditions shown in Table 2, i.e., by rolling and heat-treating after the rolling. The mechanical properties of thus formed plates are also shown in Table 2. In Tables 1 and 2, steel No. 1 to No. 5 denote respectively the steel produced by the invention and steel No. 6 to No. 9 denote respectively the steels which are given for comparison. As shown in Table 2, steels No. 1 to No. 3 of the present invention displayed, as compared with the steels for comparison No. 6 to No. 9, good resistance to the temper embrittlement, high tensile strength after the high temperature PWHT and high ductility after the step cooling. Furthermore, steels No. 4 and No. 5 having low P content displayed a remarkably good resistance to the temper embrittlement. On the other hand, the comparison steel No. 6 having high B and Si contents was provided with a low strength and a low resistance to the temper embrittlement No. 1 steels having higher N content (0.0072) were subjected respectively to the different special treatments, as indicated by 1-1 to 1-3 in Table 2.

Thus, the steels of the invention which were treated to lower Si content and subjected to Al-B treatment display the sufficient YS and TS even after the high temperature PWHT and little temper embrittlement during the use so that they are durable in extremely harsh use condition.

TABLE 1

| Steel | | Chemical composition of steels C | Si | Mn | P | Cr | Mo | B | Sol. Al | N |
|---|---|---|---|---|---|---|---|---|---|---|
| Steels of the invention | 1 | 0.13 | 0.13 | 0.51 | 0.016 | 2.19 | 0.96 | 0.0010 | 0.063 | 0.0075 |
| | 2 | 0.13 | 0.07 | 0.60 | 0.014 | 2.24 | 0.98 | 0.0004 | 0.018 | 0.0043 |
| | 3 | 0.15 | 0.06 | 0.49 | 0.011 | 2.38 | 1.03 | 0.0004 | 0.030 | 0.0041 |
| | 4 | 0.13 | 0.07 | 0.63 | 0.008 | 3.10 | 1.05 | 0.0005 | 0.033 | 0.0071 |
| | 5 | 0.15 | 0.03 | 0.81 | 0.003 | 2.38 | 1.01 | 0.0006 | 0.027 | 0.0035 |
| Steels for comparison | 6 | 0.17 | 0.55 | 0.60 | 0.018 | 2.42 | 1.03 | — | 0.027 | 0.0070 |
| | 7 | 0.13 | 0.37 | 0.48 | 0.004 | 2.19 | 1.05 | — | 0.012 | 0.0063 |
| | 8 | 0.13 | 0.43 | 0.53 | 0.020 | 2.35 | 1.05 | — | 0.023 | 0.0083 |
| | 9 | 0.14 | 0.48 | 0.31 | 0.025 | 2.23 | 0.42 | 0.0039 | 0.025 | 0.0081 |

TABLE 2

| Steel No. | | Manufacturing conditions and mechanical properties of steels: Manufacturing conditions: heating temp. for rolling (°C.) | cooling rate after rolling (°C./hr) | normalizing (°C. × hr) | PWHT (°C. × hr) | Tensile strength Charpy impact absorbed energy: PWHT only YS (kg/mm²) | TS (kg/mm²) | PWHT only vEo(kg⁻ᵐ) | vE-20(kg⁻ᵐ) | PWHT + *step cooling vEo(kg⁻ᵐ) | vE-20(kg⁻ᵐ) | Δ vts |
|---|---|---|---|---|---|---|---|---|---|---|---|---|
| Steels of the invention | 1 | 1100 | air cooling | 940° C. × 1 hr | 710° C. × 10 hr | 38.4 | 55.9 | −42 | 17.8 | −38 | 16.1 | +4 |
| | | 1250 | cover | 940° C. × 1 hr | 710° C. × 10 hr | 39.7 | 57.2 | −35 | 15.4 | −35 | 15.4 | 0 |

TABLE 2-continued

| Steel No. | | Manufacturing conditions: heating temp. for rolling (°C.) | Manufacturing conditions: cooling rate after rolling (°C./hr) | Manufacturing conditions: normalizing (°C. × hr) | Manufacturing conditions: PWHT (°C. × hr) | Tensile strength: PWHT only YS (kg/mm²) | Tensile strength: PWHT only TS (kg/mm²) | Charpy impact absorbed energy: PWHT only vEo(kg⁻ᵐ) | Charpy: PWHT only vE-20(kg⁻ᵐ) | Charpy: PWHT + *step cooling vEo(kg⁻ᵐ) | Charpy: PWHT + *step cooling vE-20(kg⁻ᵐ) | Δ vts |
|---|---|---|---|---|---|---|---|---|---|---|---|---|
| | | 1250 | cooling air cooling | 970° C. × 1 hr | 710° C. × 10 hr | 40.2 | 57.9 | −51 | 20.2 | −47 | 18.2 | +4 |
| | 2 | 1250 | air cooling | 930° C. × 1 hr 940° C. × 1 hr | 710° C. × 10 hr | 38.5 | 55.8 | −53 | 21.7 | −49 | 17.7 | +4 |
| | 3 | 1250 | air cooling | 940° C. × 1 hr | 710° C. × 10 hr | 39.1 | 57.2 | −57 | 22.1 | −59 | 21..5 | −2 |
| | 4 | 1100 | air cooling | 940° C. × 1 hr | 710° C. × 10 hr | 45.5 | 63.3 | −46 | 21.8 | −52 | 20.9 | −6 |
| | 5 | 1250 | air cooling | 940° C. × 1 hr | 710° C. × 10 hr | 39.6 | 58.8 | −54 | 21.3 | −57 | 20.7 | −3 |
| Steels for comparison | 6 | 1250 | air cooling | 940° C. × 1 hr | 710° C. × 10 hr | 39.3 | 57.8 | −5 | 7.5 | +47 | 1.3 | +52 |
| | 7 | 1250 | air cooling | 940° C. × 1 hr | 710° C. × 10 hr | 32.4 | 55.5 | 0 | 10.9 | −2 | 3.2 | −2 |
| | 8 | 1250 | air cooling | 940° C. × 1 hr | 710° C. × 10 hr | 36.2 | 51.6 | +3 | 5.2 | +43 | 0.5 | +46 |
| | 9 | 1250 | air cooling | 940° C. × 1 hr | 710° C. × 10 hr | 38.5 | 56.2 | +25 | 0.5 | +107 | 0.2 | +82 |

Figure 3:
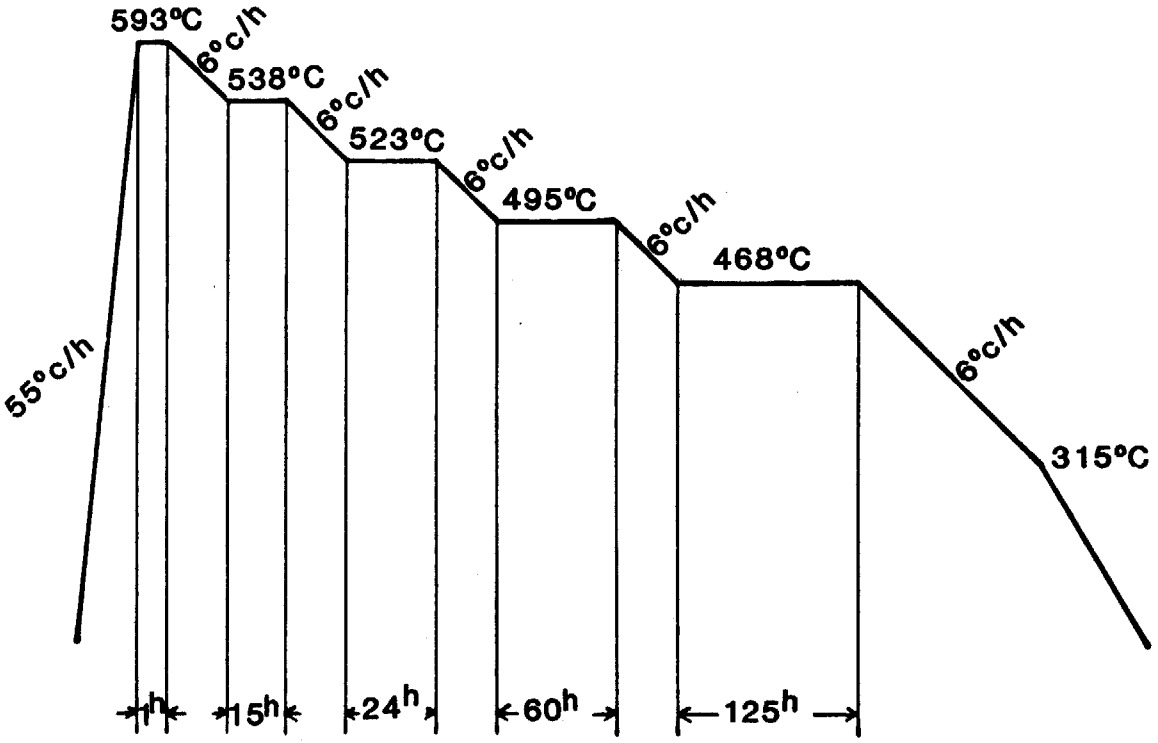
FIG. 3 is a graph showing a heat pattern of a step cooling that is an accelerating process to learn the temper embrittlement for short time.

*Carried out "step cooling" having the heat pattern shown in FIG. 3

Variations in the present invention will be apparent to those of ordinary skill in this art and yet still fall within the scope of the appended claims.

We claim:

1. A method of manufacturing a steel plate which consists essentially of 0.05 to 0.20% of C, 0 to 0.15% of Si, 0.46 to 1.00% of Mn, 2.00 to 3.50% of Cr, 0.80 to 1.20% of Mo, 0.00015 to 0.0009% of B, 0.005 to 0.070% of Sol. Al, and the balance of Fe, said method including heating a slab for the plate rolling at a temperature of not more than 1150° C.

2. A method of manufacturing a steel plate which consists essentially of 0.05 to 0.20% of C, 0 to 0.15% of Si, 0.46 to 1.00% of Mn, 2.00 to 3.50% of Cr, 0.80 to 1.20% of Mo, 0.00015 to 0.0009 of B, 0.005 to 0.070% of Sol. Al, and the balance of Fe, said method including gradually cooling the steel at a rate of not more than 30° C./hour immediately after plate rolling.

3. A method of treating a steel plate which consists essentially of 0.05 to 0.20% of C, 0 to 0.15% of Si, 0.46 to 1.00% of Mn, 2.00 to 3.50% of Cr, 0.08 to 1.20% of Mo, 0.00015 to 0.0009% of B, 0.005 to 0.070% of Sol. Al, and the balance of Fe, said method including normalizing said steel plate at a temperature of 930° C. to 1000° C., normalizing the normalized steel plate at a temperature of 900° to 970° C., and tempering the twice-normalized steel plate.

4. A method of manufacturing a steel plate which consists essentially of 0.05 to 0.20% of C, 0 to 0.15% of Si, 0.46 to 1.00% of Mn, 2.00 to 3.50% of Cr, 0.08 to 1.20% of Mo, 0.00015 to 0.0009% of B, 0.005 to 0.070% of Sol Al, not more than 0.0060% of N which is an inveritably entrained impurity, and the balance of Fe, said method including normalizing said steel plate at the temperature of 900° to 970° C. and tempering the normalized steel plate.

* * * * *